US006079559A

United States Patent [19]

Lee

[11] Patent Number: 6,079,559

[45] Date of Patent: Jun. 27, 2000

[54] SOCKET RECEIVING DEVICE

[76] Inventor: Jack Lee, No. 53, Nan Shi Keng, Da Nan Village, May Shan Hsiang, Chia Yi Hsien, Taiwan

[21] Appl. No.: 09/376,416

[22] Filed: Aug. 18, 1999

[51] Int. Cl.[7] ..... B65D 85/20; A47F 7/00

[52] U.S. Cl. ..... 206/378; 206/372; 206/443; 211/70.6

[58] Field of Search ..... 206/372, 376, 206/377, 378, 443; 211/70.6

[56] References Cited

U.S. PATENT DOCUMENTS 676,573 6/1901 Bowers ..... 211/70.6
4,144,735 3/1979 Rothenberger ..... 206/372 X
4,302,990 12/1981 Chrichton et al. ..... 206/378 X
5,484,057 1/1996 Tzu-Ching ..... 206/378 X

*Primary Examiner*—Bryon P. Gehman
*Attorney, Agent, or Firm*—Charles E. Baxley, Esq.

[57] ABSTRACT

A socket receiving device includes a base and a cover slidably mounted to the base which has a plurality of recesses for receiving sockets therein. A plurality of access openings are defined in a side of the base and respectively communicate with the recesses. The cover has a plurality of apertures separated by ribs and each aperture is located between the two adjacent recesses so that the socket in the recess is stopped by the rib. The cover has holes defined in a side thereof so that the socket can be removed from the hole corresponding thereto by adjusting the position of the cover relative to the base.

9 Claims, 5 Drawing Sheets

SOCKET RECEIVING DEVICE

FIELD OF THE INVENTION

The present invention relates to a socket receiving device which includes a base and a cover slidably connected to the base in which recesses are defined. The cover has apertures and separating ribs which are located corresponding to the recesses so that sockets in the recesses will not drop.

BACKGROUND OF THE INVENTION

A conventional socket receiving device displayed in a hardware store is shown in FIG. 1 and the device includes a base 10 and a cover 11 which is snapped to the base 10. The base 10 has a plurality of recesses 12 defined in a surface thereof so as to receive sockets in the recesses 12. The cover 11 is a transparent cover so that when the cover 11 is connected to the base 10, the sockets 13 can be seen clearly so that the consumers may check the types of the sockets 13 in the device. An inherent shortcoming of the conventional socket receiving device is that the base 10 and the cover 11 are designed for displaying purpose only, they cannot be used as a tool box carried with the users so that the consumers will discard the base 10 and the cover 11 and purchase a socket receiving box to receive these sockets 13. Furthermore, the cover 11 is easily disengaged from the base 10 because the cover 11 is connected to the base 10 by a very simple way. Once the cover 11 is disengaged from the base 10 unintentionally, the sockets 13 will spread on the ground of the hardware store.

The present invention intends to provide a socket receiving device which has secure and strong connection between the base and the cover so that the device can also bused as a socket receiving box carried with the users. The sockets received in the receiving device are well secured and the sockets can be taken from the base by pulling the cover relative to the base.

SUMMARY OF THE INVENTION

In accordance with one aspect of the present invention, a socket receiving device is provided and comprises a base having a plurality of recesses defined in a surface thereof and each recess communicating with an access opening defined in one side of the base. An engaging member is located on a first end of the base. A cover has a plate with two sidewalls extending from two sides thereof and the plate has a plurality of apertures defined therethrough. The apertures are separated by a plurality of ribs. The cover is mounted to the base by engaging the engaging member with an end of the cover.

The main object of the present invention is to provide a socket receiving device that the sockets can only be taken by adjusting the position of the slidable cover relative to the base in which the sockets are received.

Further objects, advantages, and features of the present invention will become apparent from the following detailed description with appropriate reference to the accompanying drawings.

DETAILED DESCRIPTION OF THE PREFERRED EMBODIMENTS

Figure 1:
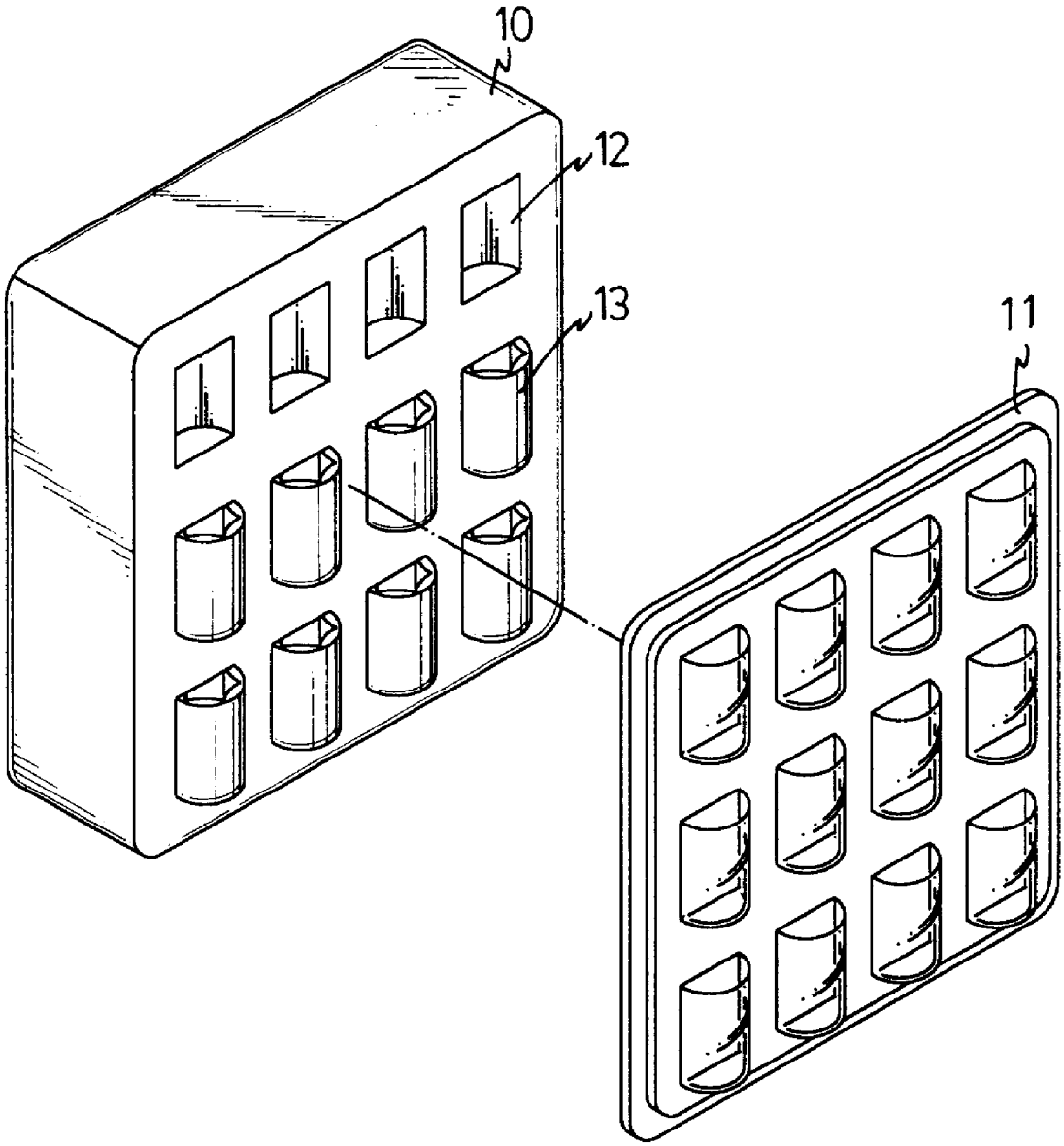
FIG. 1 PRIOR ART
FIG. 1 is an exploded view of a conventional socket receiving device.
Figure 2:
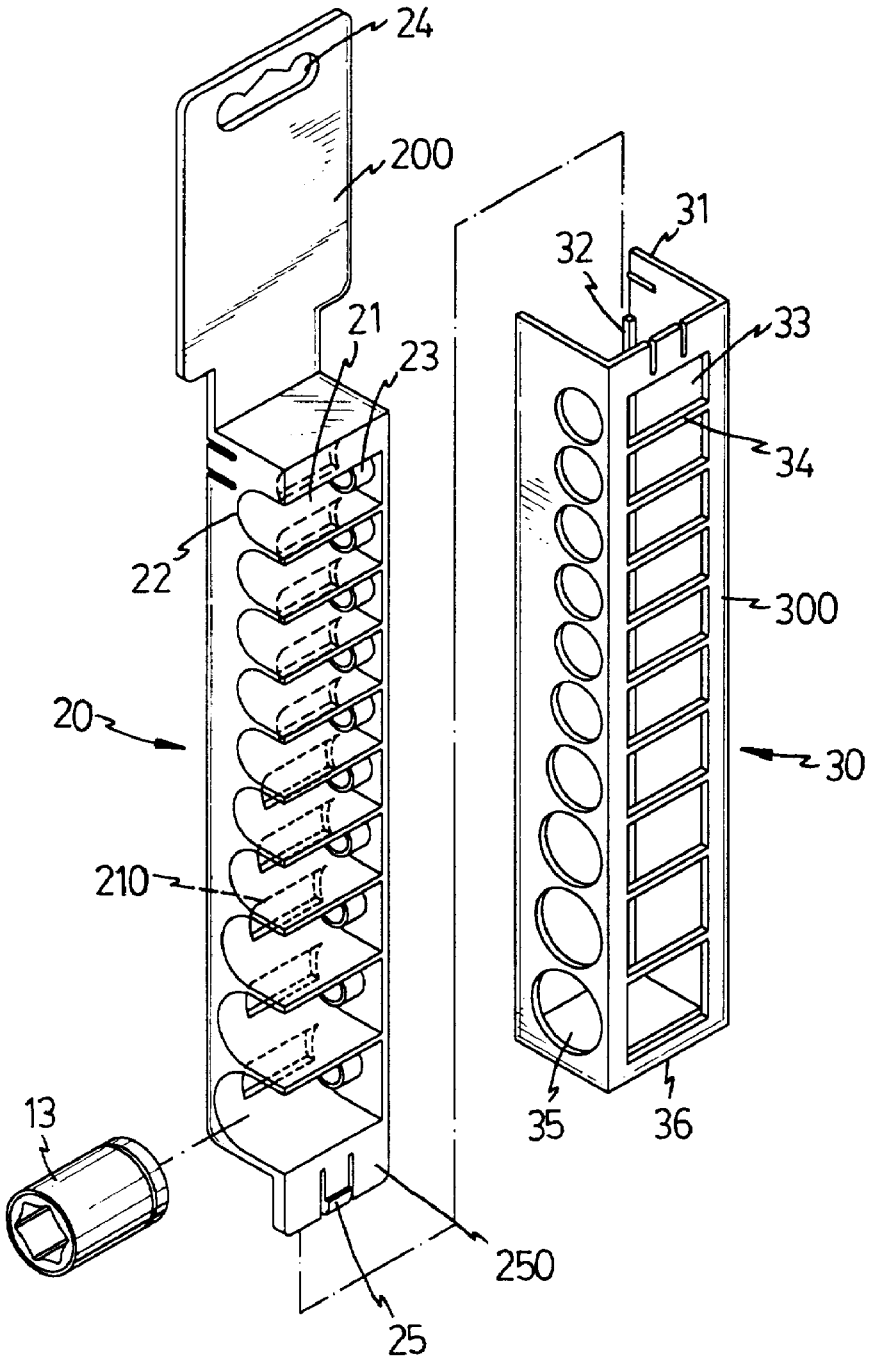
FIG. 2 is an exploded view of the socket receiving device in accordance with the present invention.
Figure 3:
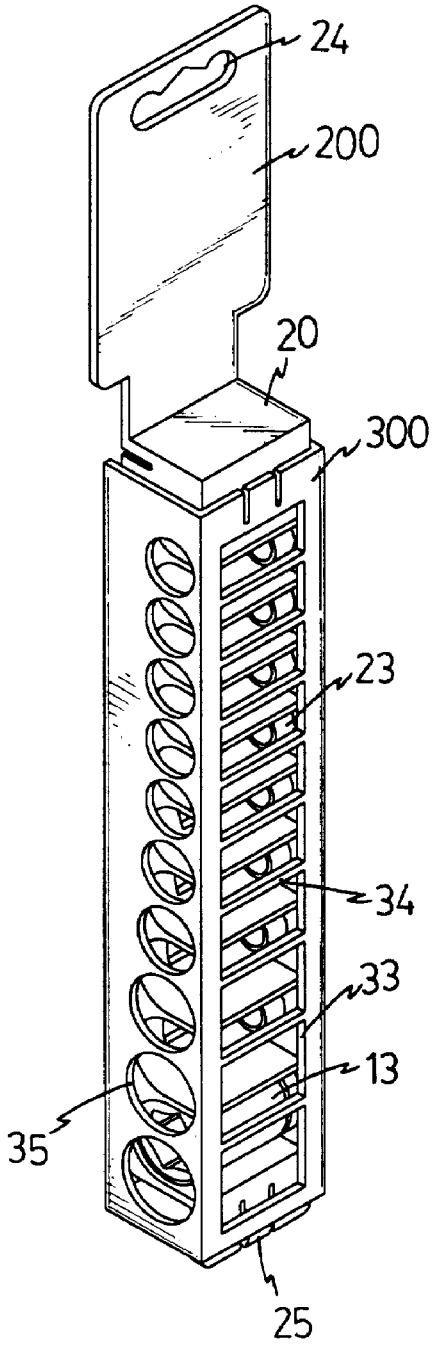
FIG. 3 is a perspective view of the socket receiving device in accordance with the present invention.

Referring to FIGS. 2 and 3, the socket receiving device in accordance with the present invention comprises a base 20 having a plurality of recesses 21 defined in a surface thereof and each recess 21 communicating with an access opening 22 defined in one side of the base 20. An extension 23 is connected to an inside defining each recess 21 and the extension 23 is located in opposite to the access opening 22. The base 20 further has a plurality of slots 210 defined therethrough and each slot 210 communicates with the recess 21 corresponding thereto. Therefore, when a socket 13 is received in a recess 21, one end of the socket 13 is engaged with the extension 23 so that the socket 13 is positioned in the recess 21. The consumers may see the socket 13 via the slots 210. A first plate 250 extends from the first end of the base 20 and an engaging member 25 is located on the first plate 250. A plate 200 extends from the second end of the base 20 and the plate 200 has a hole 24 defined therethrough so that the base 20 can be hung on a wall.

A cover 30 includes a plate 300 with two sidewalls 31 extending from two sides thereof. The plate 300 has a plurality of apertures 33 defined therethrough and the apertures 33 are separated by a plurality of ribs 34. Each sidewall 31 of the cover 30 has a rail 32 extending from an inside thereof so as to engage with the base 20 when the cover 30 is mounted to the base 20. Therefore, the cover 30 is slidably mounted to the base 20. A plurality of holes 35 are defined in one of the two sidewalls 31 of the cover 30 and each hole 35 is located in alignment with the aperture 33. When the cover 30 is mounted to the base 20, the engaging member 25 is engaged with an end 36 of the cover 30 so that the cover 30 is secured to the base 20.

It is to be noted that each aperture 33 is located between the two adjacent recesses 12 of the base 20 when the engaging member 25 is engaged with the end of the cover 30. In other words, each rib 34 is located that the socket 13 in the recess 21 is stopped by the rib 34 so that the socket 13 will not drop from the recess 21. Because each hole 35 is located in alignment with the aperture 33 corresponding thereto so that when the cover 30 is engaged with the base 20, the socket 13 in the recesses 21 will not drop from the holes 35.

Figure 4:
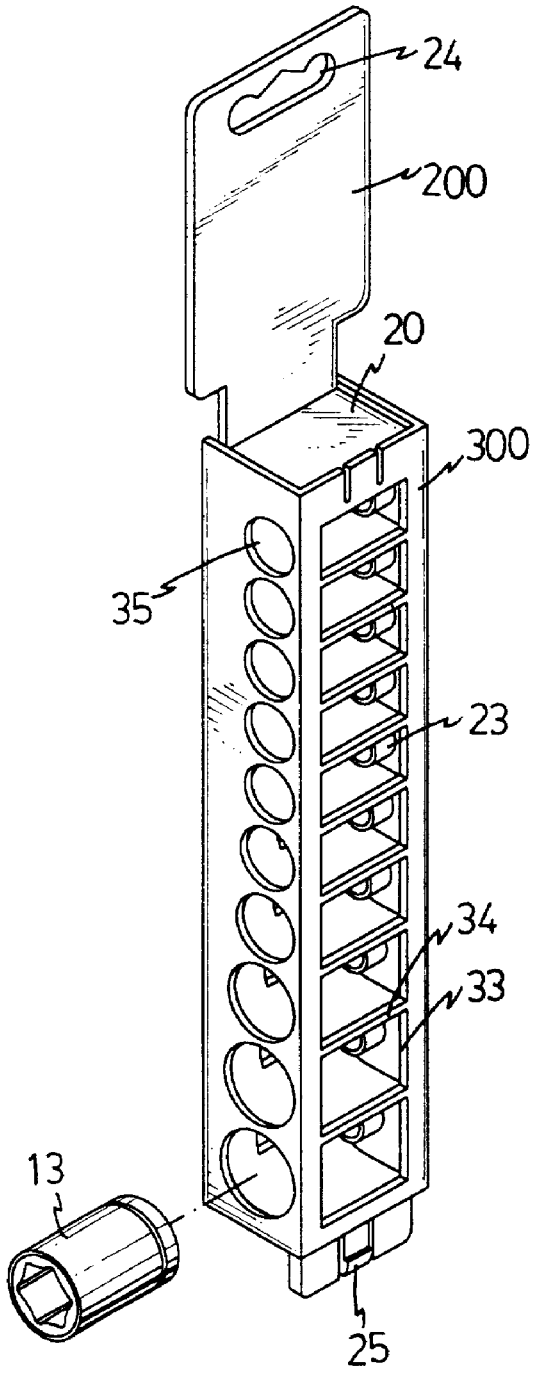
FIG. 4 is an illustrative view to illustrate the socket can be taken from the hole of the cover by pulling the cover to a suitable position.
Figure 5:
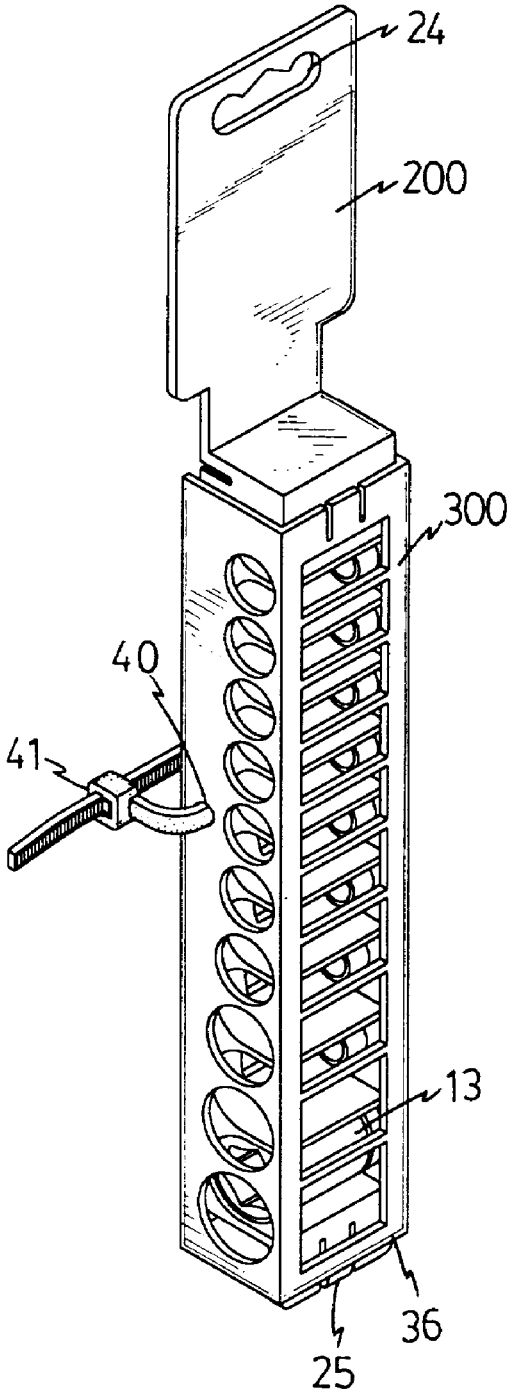
FIG. 5 is a perspective view to show that the socket receiving device in accordance with the present invention may cooperated with a tightening strip.

Referring to FIG. 4, if the user wants to take one of the sockets 13 in the recesses 21, the engaging member 25 is disengaged from the end 36 of the cover 30 and the cover 30 is pulled relative the base 20. The cover 30 is pulled to a position where an end of the desired socket 13 is in alignment with one of the hole 35 so that the socket 13 can be removed from the recess 13 via the hole 35. In this manner, the device can be used as a socket box and the sockets 13 will not drop except the user adjust the position of the cover 30. FIG. 5 shows another embodiment wherein the two sidewalls 31 each have a secure hole 40 for a tightening strip 41 to extend therethrough. The device can be secured to a frame in a hardware store by the tightening strip 41.

The invention is not limited to the above embodiment but various modification thereof may be made. It will be understood by those skilled in the art that various changes in form and detail may made without departing from the scope and spirit of the present invention.

What is claimed is:

1. A socket receiving device comprising:

a base having a plurality of recesses defined in a surface thereof and each recess communicating with an access opening defined in one side of said base, a first plate extending from the first end of said base and an engaging member located on said first plate, and a cover having a plate with two sidewalls extending from two sides thereof and said plate having a plurality of apertures defined therethrough, said apertures separated by a plurality of ribs, said cover mounted to said base and said engaging member engaged with an end of said cover so that said cover is secured to said base.

2. The socket receiving device as claimed in claim 1 further comprising a plurality of holes defined in one of said two sidewalls of said cover, each hole when, located in alignment with a corresponding said aperture, allowing removal of a retained socket.

3. The socket receiving device as claimed in claim 1, wherein each aperture is located between two adjacent said recesses of said base when said engaging member is engaged with said end of said cover.

4. The socket receiving device as claimed in claim 1, wherein each sidewall of said cover has a rail extending from an inside thereof so as to engage with said base when said cover is mounted to said base.

5. The socket receiving device as claimed in claim 1, wherein said base has a plurality of slots defined therethrough and each slot communicates with one said recess corresponding thereto.

6. The socket receiving device as claimed in claim 1 further comprising a respective extension connected to an inside of each recess.

7. The socket receiving device as claimed in claim 6, wherein each said extension is located in opposite to its respective access opening.

8. The socket receiving device as claimed in claim 1 further comprising a plate extending from the second end of said base and said base plate has a hole defined therethrough.

9. The socket receiving device as claimed in claim 1, wherein at least one of said two sidewalls of said cover has a secure hole defined therethrough and a tightening strip extends through said secure hole.

* * * * *